US005103237A

United States Patent [19]

Weber

[11] Patent Number: 5,103,237

[45] Date of Patent: Apr. 7, 1992

[54] DUAL BAND SIGNAL RECEIVER

[75] Inventor: John G. Weber, Boulder Creek, Calif.

[73] Assignee: Chaparral Communications, San Jose, Calif.

[21] Appl. No.: 254,379

[22] Filed: Oct. 5, 1988

[51] Int. Cl.[5] ..... H01Q 13/02; H01P 1/209

[52] U.S. Cl. ..... 343/786; 333/126; 333/135

[58] Field of Search ..... 333/126, 135; 343/786

[56] References Cited

U.S. PATENT DOCUMENTS

| | | | |
|---|---|---|---|
| 3,325,817 | 6/1967 | Ajioka et al. | 343/786 X |
| 3,508,277 | 4/1970 | Ware et al. | 343/786 X |
| 3,566,309 | 2/1971 | Ajioka | 343/786 X |
| 4,504,836 | 3/1985 | Seavey | 343/786 X |
| 4,558,290 | 12/1985 | Lee | 333/126 |
| 4,740,795 | 4/1988 | Seavey | 343/786 |
| 4,785,306 | 11/1988 | Adams | 343/786 |
| 4,801,945 | 1/1989 | Luly | 343/786 |
| 4,903,037 | 2/1990 | Mitchell et al. | 333/135 X |

OTHER PUBLICATIONS

Moreno, *Microwave Transmission Design Data* Dover Publ., New York, N.Y., 1948, Title page & pp. 116, 117 relied on.

*Primary Examiner*—Paul Gensler

*Attorney, Agent, or Firm*—William E. Pelton

[57] ABSTRACT

A dual band signal receiver is provided with inner and outer relatively coaxial cylindrical waveguides electromagnetically coupled to respective upper and lower band rectangular waveguides and ports through suitable polarization switching probe assemblies. The rectangular waveguides are mounted adjacent one end of the outer cylindrical waveguide. The rotatable probe assembly of the inner cylindrical waveguide is electromagnetically coupled to the high band rectangular waveguide by a suitable transmission line extending substantially along the longitudinal axis or centerline of the outer cylindrical waveguide.

29 Claims, 2 Drawing Sheets

FIG. 1
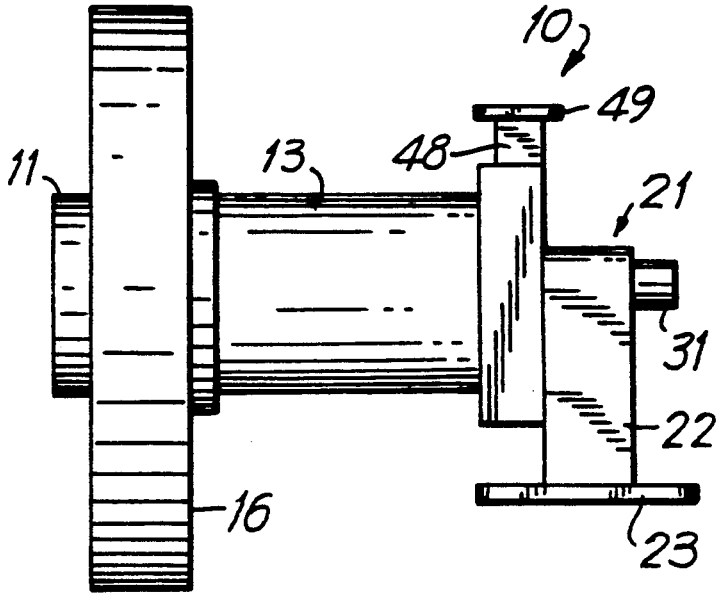
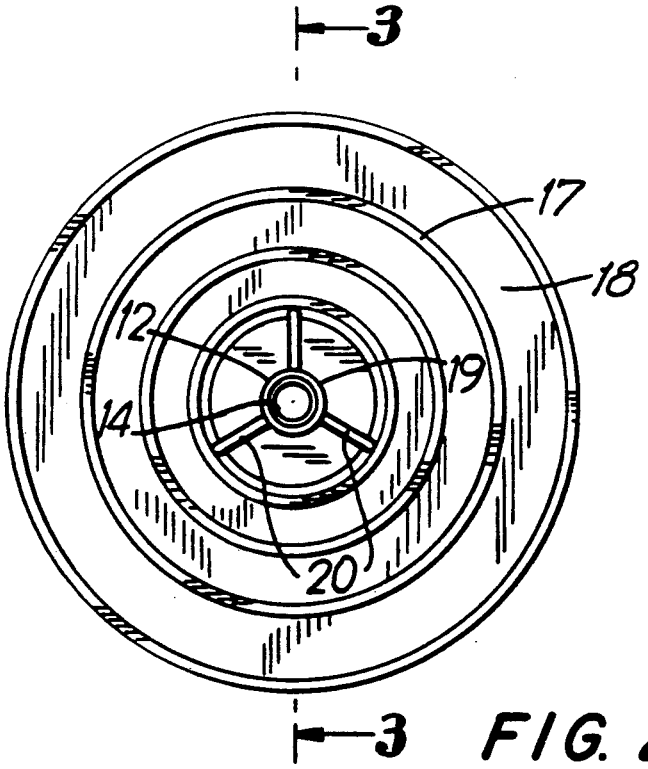
FIG. 2

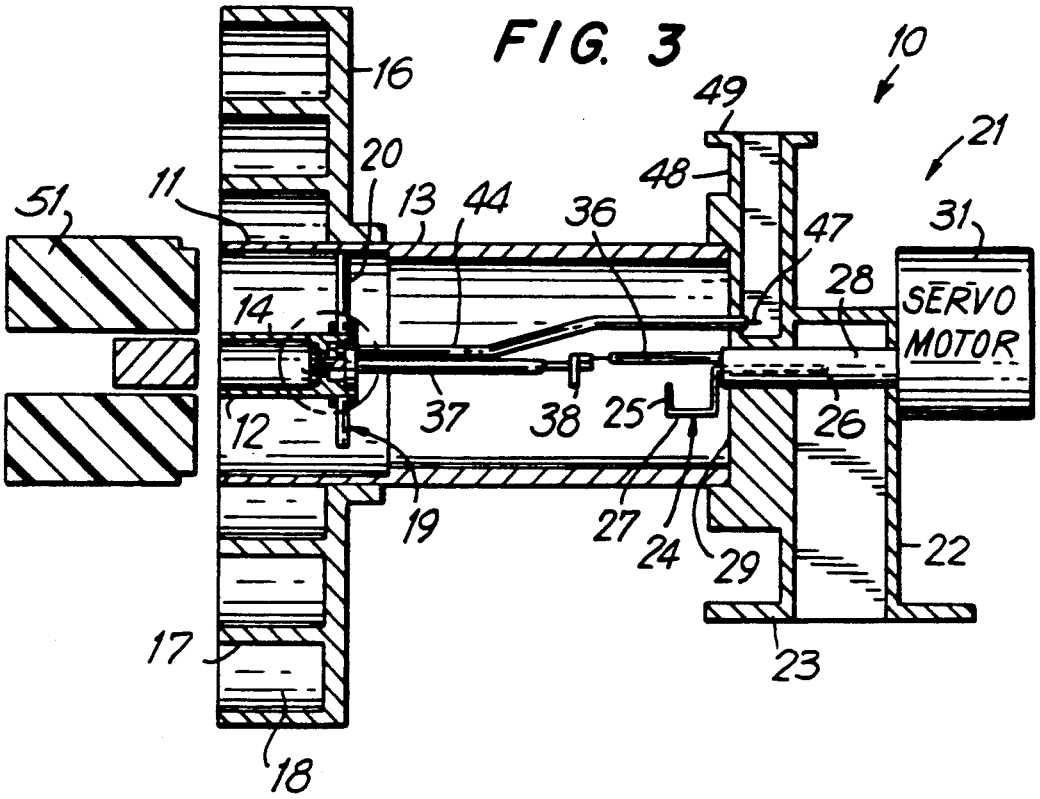
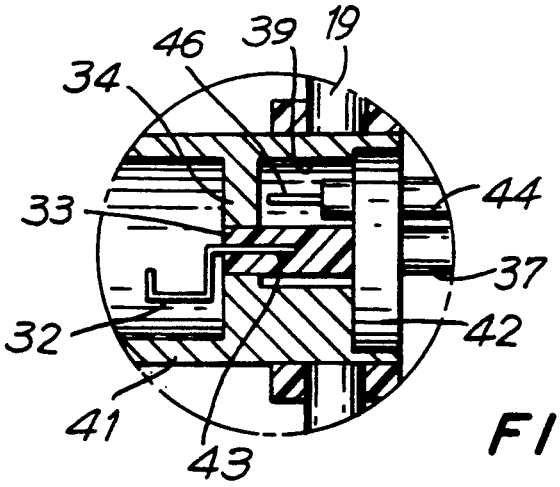
FIG. 4

DUAL BAND SIGNAL RECEIVER

FIELD OF THE INVENTION

The present invention relates to dual band antenna feeds for microwave signals and in particular to prime focus, polarization switches having a waveguide responsive to a first frequency range and coaxial with another waveguide responsive to a second frequency range so as to permit simultaneous coupling to microwave signals within each of the first and second frequency ranges.

BACKGROUND OF THE INVENTION

Satellite television, or TVRO, signal downlink equipment is presently characterized by the use of horn antennas of the type which have become known as scalar feed horns. Scalar feed horns generally consist of a cylindrical waveguide, the radiating aperture of which is surrounded by a plurality of concentric rings. Such feed horns are positioned at the focal point of a suitable reflector dish for microwave signals transmitted from a satellite in geosynchronous orbit about the earth. Until recently, TVRO satellite signals have been transmitted principally in the operating frequency band of from 3.7 to 4.2 GHz, an operating band referred to by persons in the field as the C-band. Horn antennas used for reception of TVRO signals have heretofore had to have acceptable performance characteristics over the C-band but not necessarily at other microwave frequencies.

Because of the dual polarized nature of TVRO satellite signals, moreover, horn antennas utilized for TVRO have also had to be able to switch, upon demand, from one polarization of the incoming signal to the other. This requirement has given rise to the common use of a small rotatable metal probe assembly located at the bottom or back of the waveguide and coupled electrically to a standard WR229 rectangular waveguide. Such a feed horn is shown and described in U.S. Pat. No. 4,414,516 to Taylor Howard.

In the past few years, some TVRO satellite channels have, for many reasons, been transmitted at frequencies within the range of from 11.7 to 12.2 GHz, a frequency band referred to by persons in the field as the Ku-band. Thus, some satellite television stations are transmitted in the C-band range, while others are transmitted in the Ku-band. Accordingly, it has become desirable today for TVRO earth stations to be comprised of equipment capable of receiving and processing both C-band and Ku-band signals simultaneously.

Microwave waveguide junctions consisting of coaxial waveguides for simultaneous reception of independent frequency ranges have been known heretofore. For example, U.S. Pat. No. 3,508,277 to Ware et al discloses the use of two cylindrical waveguides mounted coaxially. Ware et al however do not utilize rotatable coupling probes to achieve efficient and low cost polarization switching and do not address the problems associated with the use of such coupling techniques. U.S. Pat. No. 4,041,499 to Liu et al discloses a waveguide antenna in which inner and outer waveguides are side-fed by fixed coaxial probes. The inner waveguide is fed with a monopulse signal in the sum or in-phase mode and the outer waveguide is similarly side-fed with a monopulse signal in the difference or out-of-phase mode. Such a structure is not intended for use with TVRO signals and does not address the problems of cost effective dual frequency TVRO reception.

U.S. Pat. No. 4,740,795 to Seavey discloses a dual frequency antenna feed assembly having a pair of coaxial waveguides. In Seavey, however, the rectangular launch box for the high-band signal is mounted directly at the bottom of the high-band waveguide and exits radially from about the center of the surrounding low-band waveguide. Such an arrangement necessitates the use of four coaxial transmission lines spaced around the periphery of the low-band waveguide to transform the mode of and to conduct the low-band signal past the high-band launch box to a polarization rotator at the back of the low-band waveguide. Seavey therefore requires additional transformations of the low-band signals, is expensive to produce, time consuming to assemble and generally has too large a noise temperature for highly effective TVRO reception. In another commercially available dual frequency feed for TVRO, the Ku-band signal launch box is mounted on the scaler rings making the illumination characteristic of the feed unadjustable. In addition, the high-band signal is carried radially outwardly through the low-band waveguide line by a coaxial transmission line which traverses the throat of the low-band waveguide in a direction parallel to the electric field within the waveguide. Accordingly, the mechanism is complex, expensive and the way in which the high-band signal is extracted tends to disturb the signal and to increase the noise temperature of the device as a whole.

SUMMARY OF THE INVENTION

In contrast to the foregoing, the present invention provides a dual frequency prime focus feed horn, preferably for TVRO reception, which comprises coaxial high-band and low-band waveguides having commonly driven, substantially coaxial rotatable probe assemblies which couple the signal to respective launch boxes mounted substantially adjacent the bottom or rear wall of the low-band waveguide. Means are provided for conducting the high-band signal to its respective launch box so as to minimize any disturbance of the low-band electric field and any substantial contribution to the noise temperature of the device. Moreover, providing a launch box for the high-band signal at the rear of the device contributes to assembly efficiency and permits full illumination adjustment of suitable corrugations or scalar rings which may be mounted around the periphery of the radiating apertures. In one embodiment, the Ku-band signal is extracted from the high-band waveguide through a coaxial transmission line which extends substantially parallel to and adjacent to the longitudinal axis of the C-band waveguide. The transmission line exits through the rear wall of the C-band waveguide and couples to the Ku-band launch box preferably mounted in the webbing between the C-band waveguide and its associated waveguide launch box. The preferred arrangement provides for low production cost, a minimum number of component parts and, due to its light weight and standard size, facilitates in-the-field replacement of standard C-band feeds.

BRIEF DESCRIPTION OF THE DRAWINGS

For a further understanding of the present invention, reference may be had to the accompanying drawings, in which:

FIG. 1 is a side elevation view of an embodiment of the signal receiver of the present invention;

FIG. 2 is a front view of the device of FIG. 1;

FIG. 3 is a cross-sectional view along the line 3—3 of FIG. 2; and;

FIG. 4 is an enlarged fragmentary cross-sectional view of the area within the circle shown in phantom in FIG. 3.

BRIEF DESCRIPTION OF THE PREFERRED EMBODIMENTS

Referring now to the figures, and in particular to FIGS. 1-3, there is shown a dual frequency signal receiver 10 which consists of a first signal receiving assembly 11 and a second signal receiving assembly 12 mounted coaxially therewith. In the preferred embodiment, the receiver 11 consists of a standard cylindrical waveguide portion 13 of circular cross-section sufficient to permit propagation therein of a selected mode for microwave signals in the relatively low-band frequency range of from 3.7 to 4.2 GHz, known as the C-band for TVRO transmissions. The receiver 12 is similarly formed from a cylindrical waveguide portion 14 having a circular cross-section sufficient to permit propagation therein of microwave signals within the relatively high-band frequency range of from 11.7 to 12.2 GHz, known as the Ku-band for TVRO transmissions.

In accordance with standard practice, the low-band receiver 11 may be provided at or near the periphery of its open or radiating end with an annular metal choke plate 16. A plurality of forwardly projecting concentric corrugations or metal rings 17, referred to as scalar rings, may be placed in spaced apart positions on the forward facing surface of the choke plate 16. The rings 17 define a plurality of concentric grooves 18, the number, width and depth of which may vary, as desired. In most instances, the choke plate 16 is slidably arranged on the periphery or outer circumference of the low-band waveguide 13 and releasably held in the desired location by suitable set screws (not shown). Adjustment of the position of the choke plate and rings relative to the radiating aperture of the waveguide has been found useful in shaping the radiation or illumination pattern of the signal receiver. However, the choke plate and annular rings have sometimes been formed of a single casting together with the cylindrical waveguide portion 13 of the receiver 11.

The high-band signal receiver 12 is preferably mounted in the open throat of the C-band signal receiver 11 substantially coaxially therewith along its centerline. Means such as a plastic centering or throat support 19 are provided for positioning and securing the high-band signal receiver 12 in place. The throat support 19 may take any desired configuration including a butterfly or spider arrangement having a plurality of spaced apart legs 20 (FIG. 2) as desired. The configuration of and the plastic material of the throat support 19 are selected so as to minimize any disturbance of the microwave electric field conducted through the radiating aperture of low-band receiver 11 and yet to enable low cost and reliable reproduction. The plastic material for the throat support 19, for example, is preferably a castable form of plastic having low loss electrical characteristics, such as plastic manufactured by General Electric Corp. and sold under the trademark (LEXAN).

The low-band signal receiver 11 generally consists of the cylindrical waveguide portion 13 and a rectangular waveguide sub-assembly generally indicated by reference numeral 21. It has been known heretofore to cast the waveguide 13 and the sub-assembly 21 either separately for subsequent interconnection or together in a single casting, as desired.

The sub-assembly 21 comprises a low-band rectangular launch box 22 preferably situated just behind the bottom or rear wall of the cylindrical waveguide 13. The launch box 22 is typically a standard rectangular WR229 waveguide having a port and flange 23 adapted for standard interconnection with an elbow transition (not shown) to a suitable LNA. The WR229 waveguide may be cast together with the cylindrical waveguide 13 in a single casting, or separately cast and suitably joined to the cylindrical waveguide, as desired.

The polarization switch of the low-band receiver for TVRO reception is preferably a small rotatable metal probe assembly, generally indicated by reference numeral 24 (FIG. 3). The probe assembly 24 preferably consists of a pair of probes 25 and 26 interconnected by a transmission line section 27. The probe assembly set forth in U.S. Pat. No. 4,414,516 to H. Taylor Howard has been found to be particularly desirable for TVRO reception because of its exceptional low-loss characteristics. Other types of rotatable probes, whether monopole or dipole, may, however, be used with adequate results.

In the preferred embodiment, the probe assembly 24 is fixed into a cylindrical plastic drive shaft or holder 28 which extends through the cavity of the WR229 waveguide 22 in a direction substantially perpendicular to the direction of propagation of energy therein. The arrangement of the probe assembly in the drive shaft is such that the probe 26 extends along the rotational and longitudinal axis of the holder 28. The holder extends through the side wall of the WR229 waveguide and through the back or rear wall 29 of the waveguide 13 to terminate just inside the latter. Rotational movement is imparted to the holder 28 by a suitable servo motor 31 mounted on the outside of the WR229 waveguide 22. A suitable plastic material for the drive shaft or holder 28 is preferably that which is manufactured by Oak Materials Group Inc. and sold under the trademark (REXOLITE) because it is an insulating material having a styrene base known for its low-loss characteristics at the frequency ranges of interest. The rotational axes of the holder 28 and probe assembly 24 are substantially colinear with the centerline or longitudinal axis of the cylindrical waveguide 13.

The position of the high-band cylindrical waveguide 14 at the radiating aperture of the waveguide 13 is such that its longitudinal axis or centerline is substantially colinear with the centerline of the low-band waveguide 13 and with the rotational axis of the low-band probe assembly 24. In the preferred embodiment, the high-band waveguide 14 is similarly provided with a rotatable probe assembly 32 (FIG. 4) which has a substantially identical configuration to the probe assembly 24 but has been suitably scaled to the higher frequency range of interest. While it has been found that the probe assembly described and claimed in U.S. Pat. No. 4,414,516 to Taylor Howard has also been particularly desirable for high-band TVRO reception, other probes, monopole or dipole, or other probe assemblies known to those skilled in the art may also be utilized with acceptable results.

With reference to FIG. 4, the high-band probe assembly 32 is fixed into a plastic support or holder 33. The holder 33 is rotatably mounted in the rear wall 34 of the high-band cylindrical waveguide 14. The plastic material for the holder 33 is preferably (REXOLITE) substantially for the same reasons that (REXOLITE) brand insulating material is preferred for the drive shaft or holder 28, described above. In the preferred embodiment, the rotational axes of the high-band probe assembly 32 and its plastic holder 33 are substantially colinear with each other and with the corresponding rotational axis of the low-band probe assembly 24.

The holder 28 for the low-band probe assembly 24 may be extended so as drivingly to engage the corresponding plastic holder 33 for the high-band probe assembly 32. In this way a single servo motor 31 may be used to rotate both the high-band and low-band probe assemblies for polarization switching. One such way to extend the holder 28 is shown in FIG. 3. A first plastic extension element 36 may be eccentrically and rigidly fixed into the exposed internal end of the holder 28 within the waveguide 13. The element 36 is preferably mounted so as to extend parallel to and as close as reasonably possible to the centerline or longitudinal axis of the waveguide 13. The plastic material of the element 36 is again selected to ensure low-loss electrical efficiencies and low cost manufacturing efficiencies. For this reason, a castable plastic insulating material is preferred. One such suitable plastic material is manufactured by Hoechst Celanese Corp. and sold under the trademark (DUREL). In this embodiment, it is desirable that the element 36 not have a large cross section and thus, to preserve suitable rigidity, it extends only part way into the waveguide 13 in the direction of the high-band waveguide 14. A second plastic extension element 37 is preferably formed as an extension of, or may be suitably connected at one end to, the plastic holder 33 for the high-band probe assembly 32 and extends into the low-band waveguide 13 in a direction towards the first element 36. The element 37 may be colinear with the rotational axis of the probe assembly 32 and with the centerline of the low-band waveguide 13. In such an arrangement, the drive extensions 36 and 37 may not be colinear and in that case, a small interconnector member 38 may be employed rigidly to tie the distal or free end of each of the elements 36 and 37 together. The interconnector 38 may be formed as part of the extension 36 to define a single shaft and adapter, as desired. Accordingly, both the low-band and high-band probe assemblies may be driven by the servo motor 31. Both of the extensions 36 and 37, as well as the connector 38 are preferably made of plastic sold under the trademark (DUREL).

Other techniques may be utilized by those skilled in the relevant art for drivingly interconnecting the shaft 28 and holder 33 so as to cause both the high and low-band probe assemblies to rotate together. For example, the plastic shaft 28 may have a cylindrical protrusion (not shown) toward the high-band waveguide 14 concentric with the centerline of the waveguide 13 and extending beyond the probe assembly 24 to the holder 33 or which, alternatively, may be connected to a drive element such as the element 37. Other and various techniques of obtaining simultaneous rotation of the high and low-band probe assemblies may be used without departing from the scope of the invention, subject only to practical cost restrictions and to the requirement that loss and noise temperature of the resulting device be at an absolute minimum.

With reference to FIG. 4, there is also shown in enlarged cross-sectional view, the bottom or back wall 34 of the high-band waveguide 14. The waveguide 14 is preferably cast with a second cavity 39 situated on the other side of the back wall 34 from the open interior of the waveguide 14. In this embodiment, the holder 33 for the high-band probe assembly 32 extends through both the back wall 34 and the cavity 39 and is rotatably anchored in an end cap 42 which is mounted across the back of the casting that forms the waveguide 14 and therefore encloses the cavity 39. A launch probe 43 is formed as part of the high-band probe assembly 32 and is concentric with the holder 33 and extends a predetermined distance into the interior of the cavity 39.

A coaxial cable 44 is fixedly mounted to and extends through the end cap 42. The inner conductor of the cable 44 protrudes into the interior of the cavity 39 forming a coupling probe 46 which extends substantially parallel to and is spaced from the launch probe 43. The cable 44 thereby constitutes a transmission line. High-band waveguide signals are coupled out of the high-band waveguide 14 and are transformed to coaxial mode through the probes 43 and 46 for extraction along the coaxial transmission line 44.

With reference to FIG. 3, the transmission line 44 extends from the back end of the high-band waveguide 14 through the interior of the low-band waveguide 13. It is preferably positioned substantially parallel to and adjacent the longitudinal axis or centerline of the low-band waveguide 13 to minimize disturbance of the low-band electric field. In the preferred embodiment, the line 44 is at least semi-rigid to minimize any tendency to vibrate or the like when the signal receiver is subject to environmental stresses and to provide additional support to receiver 12 in the axial direction of the cylindrical waveguides. The line 44 passes through the rear wall 29 of the low-band waveguide substantially adjacent the point of entry of the probe assembly 24 and terminates in a launch probe 47 (FIG. 3) within a rectangular high-band launch box 48 (FIGS. 1 and 3).

In the present embodiment, the high-band launch box 48 constitutes a standard high-band rectangular waveguide of the type known as WR75. This waveguide terminates in a port flange 49 adapted for connection to a suitable elbow transition (not shown) to an LNA. The WR75 waveguide is preferably mounted behind the rear wall 29 of the low-band waveguide 13 but in front of the low-band WR229 waveguide 22, essentially in the webbing of the low-band feed horn between the cylindrical waveguide 13 and the WR229 launch 22. In the present embodiment, the WR229 and WR75 waveguides are situated so as to launch or propagate signals in substantially opposite directions, although the direction of launch is subject to modification without departing from the scope of the invention. The WR75 waveguide may be formed as part of the same casting as the low-band feed horn, or may be separately cast and mounted on the feed horn, as desired. Alternatively, the WR229 and WR75 waveguides may be formed as a single unit casting and mounted on the low-band feed horn, or the entire dual frequency receiver may be a single casting. These alternatives may be adopted by persons skilled in the art without departing from the scope of the invention. The presence of the WR75 waveguide at the back of the low-band waveguide adjacent the WR229 waveguide has been found particularly advantageous. It permits the coaxial transmission line 44 to be oriented in a direction substantially perpendicular to the electric field in the low-band feed horn thereby minimizing loss or noise which might otherwise result from disturbance of the field. It also provides cost reduction alternatives and does not interfere with the desirable adjustability of the choke plate 16 and rings 17 relative to the radiating aperture of the low-band to optimize the illumination pattern of the device to the particular size and configuration of the reflector dish with which it is used.

With reference to FIG. 3, there is shown a schematic representation of a set of conventional dielectric inserts or blocks 51. The blocks 51 may be installed, as required, diametrically across the circular cross-sections of both the high-band and low-band feed waveguides 12 and 13. Their purpose is to produce the necessary field conversion to enable use of the dual frequency receiver with circularly polarized modes of signal transmission. The configuration and utilization of such dielectric inserts or blocks 51 is set forth in U.S. Pat. No. 4,544,900 to H. Taylor Howard. Their use does not affect the scope of the present invention.

It is apparent that those skilled in the art may make modification to the specific embodiments described herein without departing from the scope of the invention. Accordingly, the invention is not to be limited except by the spirit and scope of the following claims:

What is claimed is:

1. A signal feed for simultaneously transmitting microwave signals in upper and lower frequency bands, comprising:

upper and lower band waveguide assemblies, each of said assemblies consisting of a cylindrical waveguide cavity and at least one rectangular waveguide cavity;

upper and lower band polarization switching probe assemblies, each of said probe assemblies being mounted to couple electromagnetically to signals within its respective cylindrical waveguide cavity; and transmission line means for electromagnetically coupling said upper band probe assembly and the upper band rectangular waveguide cavity, said transmission line means having substantially its entire length thereof traversing the lower band cylindrical waveguide cavity in a direction substantially normal to the direction of the electric field within the lower band cylindrical waveguide.

2. The signal feed of claim 1 in which said upper and lower band cylindrical waveguide cavities are relatively coaxially aligned.

3. The signal feed of claim 2, in which the substantially entire length of said transmission line means is substantially coaxial with said lower band cylindrical waveguide.

4. The signal feed of claim 1, in which said upper band waveguide assembly comprises three waveguide cavities electromagnetically coupled by said transmission line means and said upper band probe assembly.

5. A signal feed for simultaneously transmitting microwave signals in upper and lower frequency bands, said signal feed comprising:

a first waveguide for transmitting signals in the upper band;

a second wave guide for transmitting signals in the lower band;

upper and lower band waveguides defining respective upper and lower band ports clustered adjacent one end of said second waveguide;

a first electric field sampling probe in said first waveguide; and a coaxial line electromagnetically coupling said first electric field sampling probe and said upper band waveguide and port.

6. The signal feed of claim 5, in which said upper and lower band waveguides are substantially adjacent one another.

7. The signal feed of claim 6 in which said one end of said second waveguide is closed and said upper and lower band waveguides are mounted behind the closed end of said second waveguide.

8. The signal feed of claim 7 in which said upper band waveguide is closer to said closed end than said lower band waveguide.

9. The signal feed of claim 7 in which said upper and lower band ports face radially outwardly relative to the longitudinal axis of said second waveguide.

10. The signal feed of claim 9 in which said upper and lower band ports face in substantially opposite directions.

11. The signal feed of claim 5 in which said coaxial line extends along its length in substantially the same direction as the longitudinal axis of said second waveguide.

12. The signal feed of claim 11 in which said coaxial line extends substantially adjacent and parallel to the centerline of said second waveguide.

13. The signal feed of claim 12 in which the signal carrying conductor of said coaxial line traverses said one end of said second waveguide and extends to and terminates at a predetermined distance into said upper band waveguide.

14. The signal feed of claim 5 comprising, in addition, means abutting the interior walls at the other end of said second waveguide for mounting said first waveguide substantially concentrically within said second waveguide.

15. The signal feed of claim 14 in which said first and second waveguides are substantially coaxial.

16. The signal feed of claim 14 in which said mounting means comprises a dielectric member.

17. The signal feed of claim 5 comprising electromagnetic energy transparent means connected to said first electric field sampling probe and extending longitudinally through said second waveguide and means for rotating said first electric field sampling probe engaging said electromagnetic energy transparent means.

18. The signal feed of claim 5, wherein said first waveguide includes a rear face, said rear face being in facing relationship with said one end of said second waveguide.

19. The signal feed of claim 5 comprising means for electromagnetically coupling said first waveguide to said coaxial line.

20. The signal feed of claim 19 in which said electromagnetic coupling means comprises a second electric field sampling probe electrically connected to said first field sampling probe and a radiating cavity, said second sampling probe being within said radiating cavity.

21. The signal feed of claim 20 comprising in addition a third electric field sampling probe, said third sampling probe being within said radiating cavity and forming a conductor of said coaxial line.

22. The signal feed of claim 21 in which said first and second sampling probes are interconnected so as to comprise a rotatable upper band probe assembly.

23. The signal feed of claim 22 comprising means for rotating said upper band probe assembly.

24. The signal feed of claim 23 in which said second waveguide comprises a rotatable lower-band probe assembly.

25. The signal feed of claim 24 in which said rotatable lower band probe assembly is rotatably engaged by said means for rotating said upper band probe assembly thereby to cause said upper and lower band probe assembly to rotate simultaneously.

26. The signal feed of claim 25 in which said rotating means comprises a unitary drive shaft rotatably engaged by an electric motor.

27. The signal feed of claim 26 in which at least a portion of said drive shaft is substantially colinear with the centerline of said second waveguide.

28. The signal feed of claim 27 in which the remainder of said drive shaft is substantially adjacent and parallel to said centerline of said second waveguide.

29. A coaxial dual frequency antenna feed assembly comprising:

a generally circular horn defining a first circular aperture and waveguide cavity having boundary walls;

a first probe for detecting electromagnetic energy in a first frequency band exposed to incident electromagnetic energy in said first circular aperture and positioned within said first waveguide cavity including a portion thereof coaxial with said first circular aperture and waveguide cavity;

means outside of said first circular aperture and waveguide cavity for rotating said first probe to change the polarization thereof;

means defining a second circular aperture and waveguide cavity of smaller size than said first circular aperture and waveguide cavity;

a second probe exposed to incident electromagnetic energy in said second circular aperture and positioned within said second waveguide cavity for detecting electromagnetic energy entering said second circular aperture in a higher frequency band than electromagnetic energy detected by said first probe;

means for positioning said means defining said second circular aperture coaxially within said first circular aperture and waveguide cavity and wherein said means defining said second aperture is spaced from all of the boundary walls of said first circular aperture and waveguide cavity;

signal conducting means for transmitting electromagnetic energy detected by said second probe having substantially its entire length extending substantially longitudinally through said first waveguide cavity to the exterior thereof; and means for rotating said second probe to change the polarization thereof, said rotating means extending longitudinally through a portion of said first waveguide cavity and into rotational coupling engagement with said second probe.

* * * * *